United States Patent [19]

Pickles

[11] Patent Number: 4,749,169

[45] Date of Patent: Jun. 7, 1988

[54] PORTABLE POWERED SCREW JACK ACTUATOR UNIT

[75] Inventor: Joseph Pickles, Troy, Mich.

[73] Assignee: Casco Products Corporation, Bridgeport, Conn.

[21] Appl. No.: 794,842

[22] Filed: Nov. 4, 1985

Related U.S. Application Data

[63] Continuation-in-part of Ser. No. 548,708, Nov. 4, 1983.

[51] Int. Cl.[4] ..... B66F 3/22

[52] U.S. Cl. ..... 254/122; 254/DIG. 4

[58] Field of Search ..... 254/122, 126, DIG. 4; 74/801; 403/157, 159

[56] References Cited

U.S. PATENT DOCUMENTS

| | | | |
|---|---|---|---|
| 1,324,898 | 12/1919 | Hopcraft | 254/DIG. 3 |
| 3,997,143 | 12/1976 | Rose | 254/122 |
| 4,170,804 | 10/1979 | Scotcher | 403/157 |
| 4,366,727 | 1/1983 | Jonsson | 74/801 |

*Primary Examiner*—Frederick R. Schmidt
*Assistant Examiner*—Judy J. Hartman
*Attorney, Agent, or Firm*—H. Gibner Lehmann; K. Gibner Lehmann

[57] ABSTRACT

A motorized user applied actuator for automobile and like jacks having rotatable operating members for raising and lowering the jack platform, comprising a casing having a drive member detachably cooperable with the jack operating member, and having an electric motor and a unique, compact and lightweight, simple yet highly efficient step-down transmission connecting the motor with the drive member. The transmission comprises a plurality of staged planetary assemblages which effect a great reduction in speed and advantageous conversion of power. In several illustrated embodiments of the invention one or more handles are attached to the motor casing to provide a convenient hand grip. In another form of the invention the hand grip is supplemented by a fitting which separably interlocks with the jack structure to assume the torque on the motor casing. A power cord for the actuator has a plug adapted to be received in the cigar lighter socket of a motor vehicle. In one embodiment the drive member of the actuator has back-to-back elements alternately engageable with the jack operating member to effect a reversal of the jack movement without reversing the motor.

16 Claims, 4 Drawing Sheets

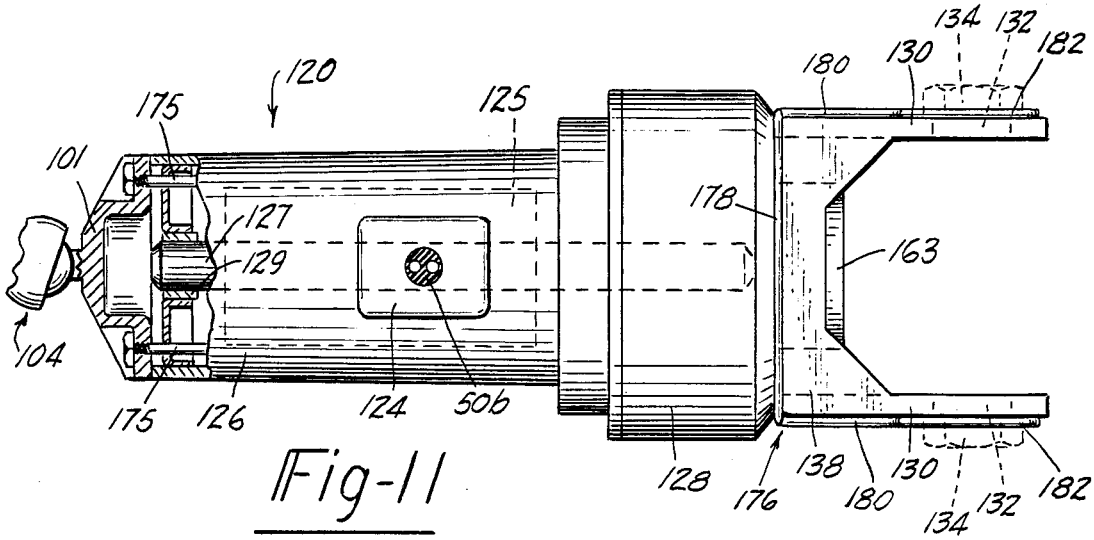
Fig-11
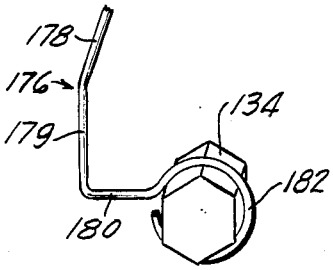
Fig-15
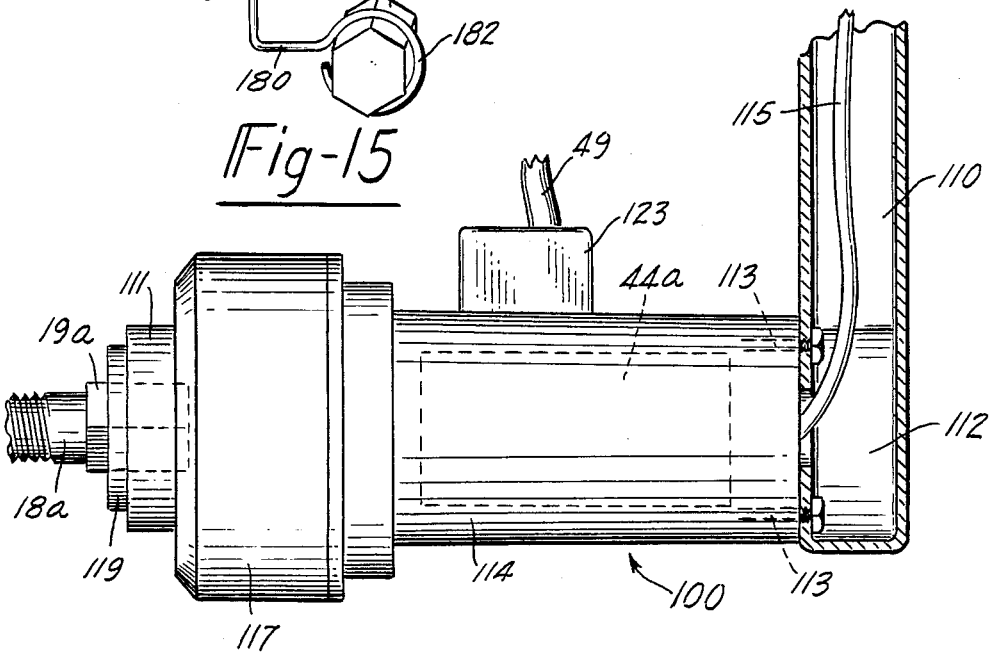
Fig-12
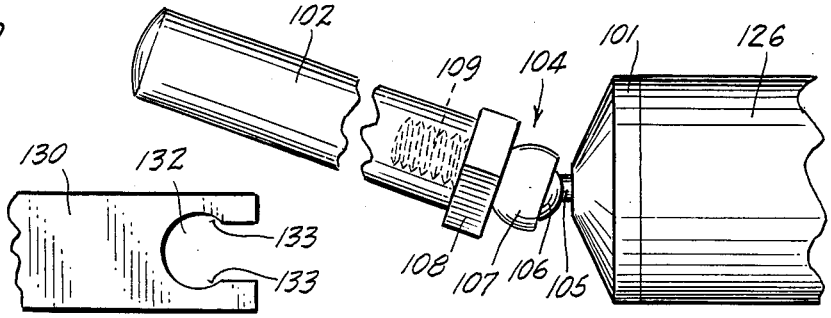
Fig-13
Fig-14

PORTABLE POWERED SCREW JACK ACTUATOR UNIT

BACKGROUND OF THE INVENTION

This application is a continuation-in-part of U.S. application for Letters Patent Ser. No. 548,708 filed Nov. 4, 1983 in the name of Joseph Pickles and entitled MOTOR VEHICLE JACK OPERATOR.

The present invention relates to powered means or jacks for raising heavy objects, and more particularly to electrically powered jacks intended for this purpose.

There are quite a few known types of jack mechanisms for lifting heavy objects, such as motor vehicles off the ground. Many such jacks are so large and heavy as to not be easily portable. For example, some well-known hydraulic jacks, in which a working fluid is delivered into a cylinder under pressure to act upon a piston that lifts the load platform, are constructed of heavy metal parts to withstand the forces involved when an automobile is to be raised. The viscous fluid used in such jacks substantially increases their weight, and the complexity of constructing the required fluid passageways and check valves substantially increases the cost.

Although most commercial automobile hydraulic jacks are quite large and typically provided with casters so that they can be easily maneuvered into position under a motor vehicle, their weight and bulk prohibit their use as portable emergency jacks of the kind that could be conveniently and compactly transported in a motor vehicle ready for use when the need arises.

One widely used portable jack is the type known as a "bumper jack", which is often provided as original equipment with motor vehicles. Such a jack employs a vertical rack and a pawl mechanism in which the pawl sequentially engages a series of shoulders or teeth along the rack in response to manual actuation of a lever. Typically, the lever comprises a long-handled lugnut wrench which is slidable into and removable from the pawl assembly; the vertical rack is usually removably mountable in a base plate.

While this type of bumper jack is of light weight and can be readily dismantled so as to be conveniently stored in a rear deck or trunk compartment of a motor vehicle, it is known that the bumper of the vehicle must be strong enough and especially manufactured to support the weight of the car, as well as being designed to properly engage the lifting hook of the jack. In the event that the bumper has been damaged, or the connection between the bumper and the vehicle does not provide sufficient support for the lifting of the vehicle, the jack cannot alternately be used to engage other structural members of the motor vehicle such as a framing member. Moreover, such bumber jacks require the exertion of substantial physical effort in order to operate them, and thus they are not well adapted for use by infirm or handicapped persons.

Another previously known type of jack comprises a scissors mechanism which is used to lift the frame member or other body supporting structure of the motor vehicle above the ground surface. Such a mechanism generally comprises a lazy tong arrangement which is expanded and contracted in response to the rotation of an elongated screw threaded member. Typically, one end of the elongated screw threaded member includes an hexagonal head substantially the same size as the head of a wheel lug nut so that a lug nut wrench can be used to raise the jack. This jack structure still requires the exertion of a substantial effort to raise and lower the lifting platform. Moreover, the wrench must be repeatedly engaged upon and removed from the hexagonal head of the screw threaded member, since the arc of swing of the wrench is limited by the ground surface and/or portions of the motor vehicle.

Several previously-known devices intended to overcome the problem of repeatedly applying and turning the lug wrench used to operate a jack comprise an elongated base upon which the lifting structure is mounted, together with an electric motor on the base, that is connected to rotatably drive the screw member. Jacks of this type are shown in U.S. Pat. Nos. 2,218,733; 2,661,927; 3,451,655; 3,645,501; and 3,623,707. None of these patents discloses a powered jack actuator constituted as a unit distinct and separate from the lifting structure and which can be instantly, easily applied to the lifting structure to actuate the same at such time that the use of a jack is required.

U.S. Pat. No. 2,218,733 shows a scissors jack and integral motor 36 driving the actuator screw through reduction spur and pinion gearing 37, 38, 39 and 35.

U.S. Pat. No. 2,661,927 shows a scissors jack with an integral motor 23 driving the actuating screw through a chain drive 24, 25 and 26.

U.S. Pat. No. 3,451,655 shows a scissors type jack with an integral motor 38, extensible coupling 62 and gear box 24 connected with the jack screw 20.

U.S. Pat. No. 3,623,707 shows a scissors jack with an integral motor 18 driving the actuator screw through a coupling 154.

U.S. Pat. No. 3,645,501 shows a lever-type jack having an integral motor 24 driving an actuator screw 13 through a driven gear 23.

However, these previously known motorized jack mechanisms are physically larger and substantially heavier than the ordinary manually-operated jack mechanisms, and are not well adapted for use as a portable jack which can be conveniently stored and transported for use in emergency situations. As is recognized, portable jacks should not substantially decrease the available storage space in the trunk or other compartment of a motor vehicle.

SUMMARY

The above drawbacks and disadvantages of prior lifting-type jacks are obviated by the present invention, and one object of the invention is to provide a novel and improved, commercially feasible motorized jack actuator unit as an accessory device which is distinct and separate from the jack, and which can be hand or manually applied to and removably engaged with the rotatable screw of existing jack structures by the user at the time that the need arises, said unit being preferably although not necessarily applicable for use with scissors-type jacks.

Another object of the invention is to provide an improved, motorized jack actuator unit as above set forth, which is especially small and light in weight.

A related object of the invention is to provide an improved jack actuator unit as above characterized, which is powerful in its action and capable of reliably lifting very heavy objects without faltering.

Still another object of the invention is to provide an improved jack actuator unit of the kind indicated, which is particularly easy and convenient for the user to apply and put into use.

Yet another object of the invention is to provide an improved jack actuator unit as outlined above, which is capable of being powered from the battery source of the vehicle while still having the necessary torque to effect the required lifting.

A still further object of the invention is to provide an improved jack actuator unit in accordance with the foregoing, which is strong and sturdy in its construction, and foolproof in operation whereby it is not likely to fail at the time of need.

Another object of the invention is to provide an improved jack actuator unit as set forth above, wherein no special skills are required to apply it and in its operation, and wherein the average person with simple instructions can readily apply it and thus avail himself of its use.

A further object of the invention is to provide an improved jack actuator as characterized, which is especially simple in construction and economical and inexpensive to manufacture.

Still another object of the invention is to provide an improved motorized jack actuator as above described, which is readily adaptable to a wide variety and style of jack.

An important feature of the invention is the provision, in a motorized jack actuator, of a unique, powerful staged planetary gear reduction which results in a small and compact unit having a symmetrical, in-line drive.

Still another feature of the invention is the provision of an improved motorized jack actuator unit that is quickly manually attachable by the user to existing jacks, and wherein the operating torque can be assumed entirely by the jack structure.

A still further object of the invention is to provide a novel and improved combination of screw-type jack and separable motorized actuator unit therefor, wherein the actuator unit has the various atttributes set forth above, resulting in a unique combination tool which is especially advantageous as an accessory for automotive vehicles.

In accomplishing the above objects the invention provides a unique motorized jack actuator unit or accessory where is separate and complete in and of itself and adapted to be user-applied, comprising essentially a housing which rotatably supports a drive and coupling member that is powered by an electric motor contained within the housing. An elongate handle is provided, carried by the housing for user applying maneuvering and positioning the jack actuator not only with respect to the drive screw of the jack but also for positioning the jack at the desired location under the vehicle. The actuator unit also includes a manually engageable switch which is preferably mounted on a portion of the handle for the housing, to activate and deactivate the motor. A power cord is provided to energize the motor from the automobile battery system so as to eliminate the need for storing a power source within the housing. This contributes to the lightweight feature and portability of the unit. The power cable for the motor preferably includes an electrical fitting or plug adapted to be received in the cigar lighter socket of the motor vehicle.

Thus the present invention provides a motorized jack actuator unit which can be conveniently user applied to the drive screw of a jack, which is light in weight and readily portable, and coneniently stored in the carrying compartment of the motor vehicle. The actuator unit is easily applied, manipulated and positioned by the user due to the provision of the handle, and enables a jack to be readily raised or lowered without substantial physical exertion on the part of the user.

I have found that the torque available at the driver coupling member of the unit is substantial and fully adequate to operate various different types of portable scissors jacks, notwithstanding the relatively small amount of power being supplied to the motor, and the relatively small power output of the latter. The present powered actuator eliminates the need for access to a standard commercial electrical outlet which may not be available in an emergency situation on the highway. These and other advantages will be more fully understood upon review of the following detailed description.

Still other features and advantages will hereinafter appear.

In the accompanying drawings, illustrating several embodiments of the invention:

FIG. 11 is a top plan view, partially in section, of the jack actuator shown in FIG. 5.

FIG. 12 is a side elevational view, partially in section, of the jack actuator shown in FIG. 4.

FIG. 13 is a fragmentary detail, in elevation, of an arm of the attachment fork of the actuator of FIG. 5.

FIG. 14 is a fragmentary elevational view of the jack actuator of FIG. 5, and

FIG. 15 is a fragmentary perspective view of a spring clip utilized to hold the actuator attached to a jack.

Figure 1:
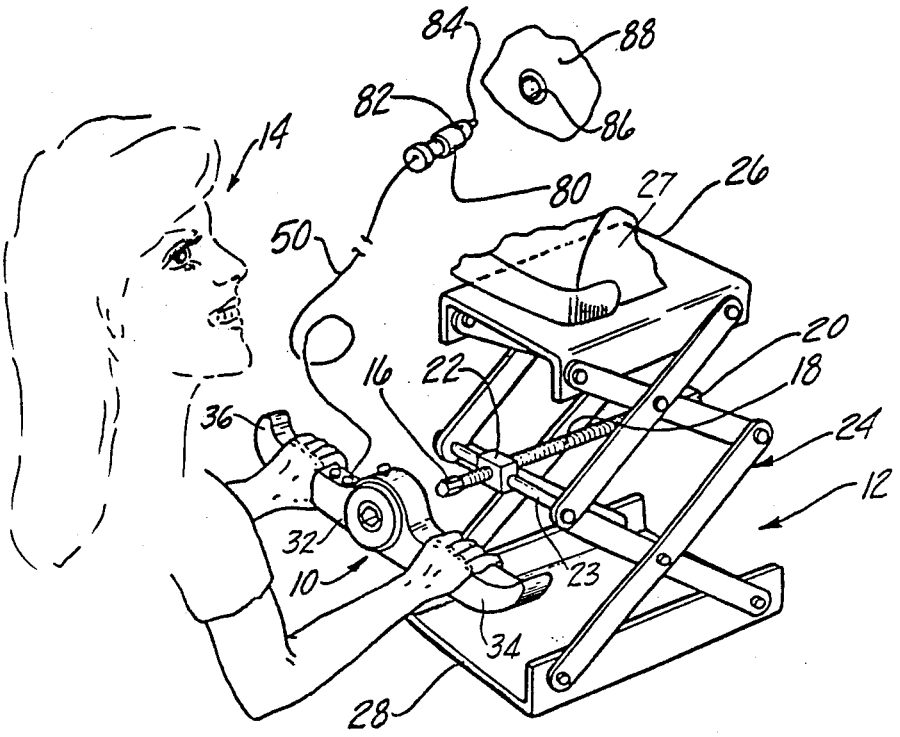
FIG. 1 is a perspective view of one form of jack actuator unit of the invention, being used in combination with a scissors jack.

Referring first to FIG. 1, the improved powered means for raising heavy objects as provided by the invention comprises a unitary powered jack actuator indicated generally by the numeral 10, such actuator being shown as user applied by a user 14 to an already existing type of scissors jack 12. The actuator unit 10 is illustrated as being grasped and manipulated by the user so as to fit it onto the extending hexagonal head 16 of an elongated, threaded rod member or screw 18 of the jack 12. Typically the jack 12 is so constructed that the screw 18 at one end is rotatably mounted in a bearing block 20 without permissible axial movement, and at its other end the screw threads into a nut block 22 which is entrained on a cross bar 23 extending between spaced apart, expansible scissors mechanisms 24 that form the sides of the jack. The screw 18 thus extends across an expansible jointed portion of the combined scissors mechanisms 24. The ends of the top links of each scissors mechanism 24 are pivotally secured to a load platform 26 engaged under a vehicle body or frame 27 whereas the ends of the bottom links of the scissors mechanisms 24 are secured to a base 28. The load platform 26 and the base 28 can be conveniently provided as one-piece plates formed with parallel side flanges to which the scissors mechanisms 24 are pivotally secured.

The jack illustrated in FIG. 1 is particularly advantageous for its simplicity of construction and the fact that in its fully retracted position, it is very compact for convenient storage, as is the case with many scissors jacks. However, it will be understood that different interlinking type or scissors type jacks can also be used in conjunction with the present improved unitary jack actuator in accordance with the present invention; it is only necessary that the existing jack include a rotatable member or screw which effects the raising and lowering of the load platform.

Referring again to FIG. 1, the rotation of the screw 18 causes the nut bock 22 to travel along it in one direction or the other; for instance, the nut block 22 can travel toward the bearing block 20, so as to cause the load platform 26 to be raised above the base 28. Conversely, rotation of the screw 18 in the opposite direction will then cause the nut block 22 to traverse the screw 18 in the opposite direction, for instance toward the hexagonal head 16 of the screw 18, lowering the platform 26.

Figure 2:
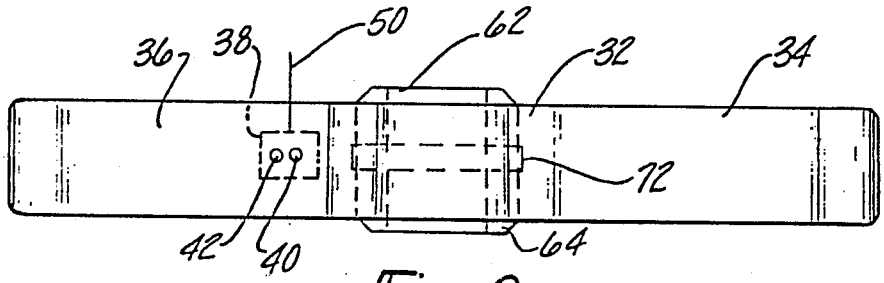
FIG. 2 is a top plan view of the jack actuator of FIG. 1.
Figure 3:
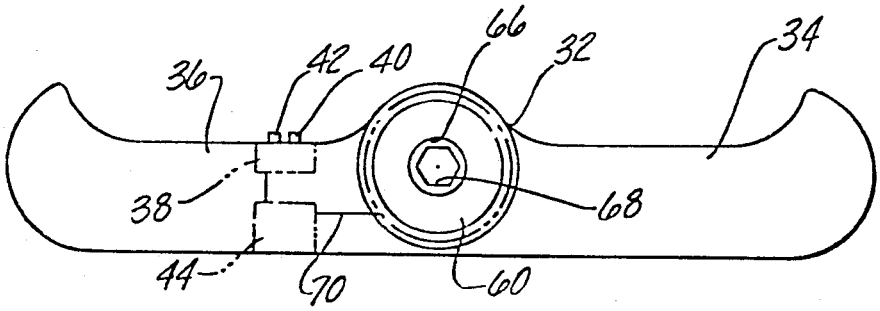
FIG. 3 is a side elevational view of the jack actuator of FIGS. 1 and 2.

Referring to FIGS. 2 and 3, the jack actuator unit 10 comprises a housing 32 having a pair of elongated handles 34 and 36 extending outwardly from opposite portions thereof. The handles 34 and 36 can be easily grasped and held by the user 14 for manipulating and positioning (user applying) the actuator unit 10 on or to the screw head 16, as well as for operating the actuator to raise and lower the car body 27. In addition, as shown in FIG. 2, the handle 36 is provided with a switch 38 having a start button 40 and a stop button 42 protruding therefrom, whereby the switch is conveniently accessible to the user 14. The switch 38 closes an electrical circuit from the power cord 50 to an electric motor 44, illustrated diagrammatically in FIG. 3.

The housing 32 rotatably mounts an annular sleeve or coupling part 6 which is retained in axial position by annular tapered bearing rings 62 and 64 secured to opposite sides of the housing. The sleeve 60 fixedly telescopically carries in it a double-ended drive member comprising a tubular socket 66 having a hexagonal bore 68 shaped to slidably receive the head 16 of the jack screw 18 in either end during the user-application. The bearing rings 62 and 64 define an enlarged aperture on each side of the housing 32 through which the axial ends of the tubular socket 66 are exposed exteriorly of the housing 32. Thus, each end of the tubular socket 66 can be work-performing being adapted to selectively receive the head 16 of the screw 18.

In addition, as indicated only diagrammatically in FIG. 3 at 70, a unique and advantageous, simplified high-efficiency inline transmission is provided by the invention, to drivingly connect the motor 44 to the sleeve 60. A schematic representation of this transmission is seen in FIG. 2, wherein the sleeve 60 could have a peripheral gear ring 72 theoretically to engage pinion and other gearing (not shown) connected with the shaft of the motor 44. This provides a reduction in the speed of rotation of the sleeve 60 of approximately 180:1 with the attendant torque conversion.

Referring again to FIG. 1, the power cord 50 that extends from the switch 38 includes a plug 80 at its other end. The plug 80 has electrical contact elements 82 and 84 electrically insulated from each other by the cylindrical plug body, which provide electrical contact with cooperable electrical contact elements (not shown) of a conventional cigar lighter socket 86 in the dashboard 88 of the motor vehicle 27.

It will be understood that both ends of the tubular socket 66 are exposed exteriorly of the housing 32 so that the reversing of the drive mechanism in this respect is simplified. For example, a uni-directional electric motor can be controlled by the switch 38, and the jack screw 18 can be rotated either clockwise or counterclockwise by the user merely reversing the application of the actuator socket 66 to the head of the screw. Although it is then not necessary to use a reversible motor when both ends of the tubular socket 66 are exposed at the housing 32, it will be understood that such a motor can also be used with the jack actuator 10 in accordance with the present invention.

Figure 4:
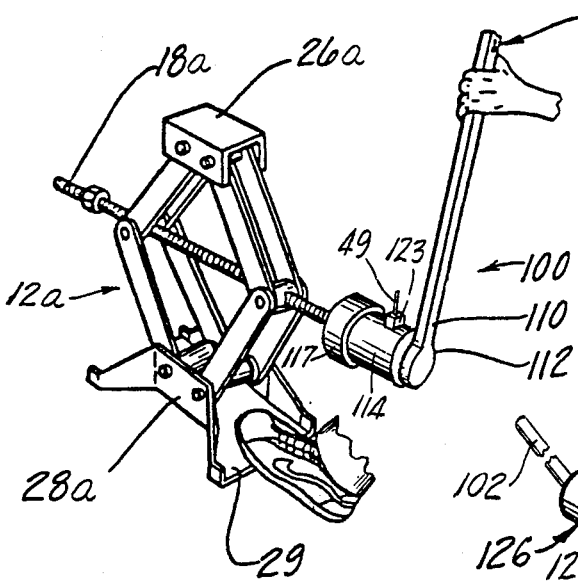
FIG. 4 is a perspective view of another embodiment of jack actuator of the invention, as applied to a scissors jack having a foot plate.
Figure 5:
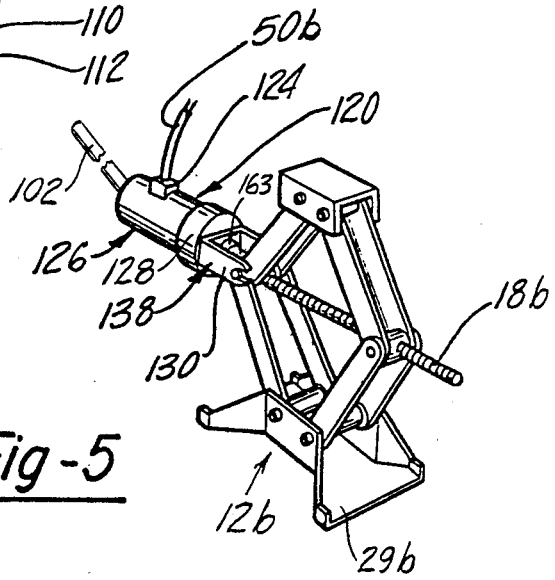
FIG. 5 is a perspective view of still another jack actuator according to the present invention, showing a further modification thereof.
Figure 6:
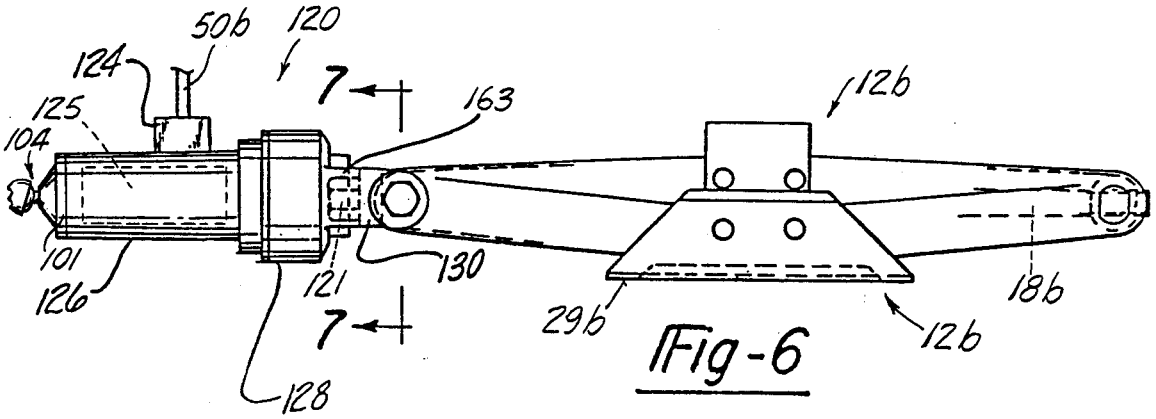
FIG. 6 is a side elevational view of the jack actuator and jack of FIG. 5.
Figure 7A:
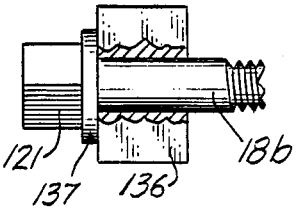
FIG. 7A is a fragmentary side elevational view of the jack portions shown in FIG. 7.
Figure 7:
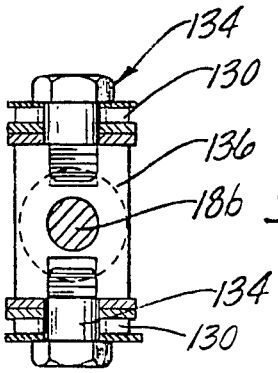
FIG. 7 is a sectional view taken substantially along the line 7—7 of FIG. 6.

Referring now to FIGS. 4 and 12, another embodiment of the invention is illustrated, comprising a jack actuator generally indicated by the reference numeral 100. The jack actuator 100 includes an elongated handle 110 having an enlarged housing portion 112 attached by tie bolts 113 to the motor housing 114. Mounted at the opposite end of the motor housing 114 is a unique, multi-staged in-line planetary transmission in a housing 117 that rotatably mounts a drive member 119 in a bearing 111, the member 119 being adapted to receive the hexagonal screw head 19*a* of the screw 18*a*. The handle 110 is substantially longer than the maximum height of the load platform 26 *a* on the jack 12*a* so that the handle can be easily grasped while a user operating the actuator stands erect. According to the invention, the jack 12*a* is provided with a base extension 29 of the base 28*a* on which the user can place his foot as seen in FIG. 4, to steady the jack.

Electrica leads 115 from the motor 44*a* pass through the handle 110 to a switch 116 at the extremity thereof, for the purpose of controlling the energization of the motor. On the motor housing 114 an electrical connector fitting 123 is provided, to bring out the motor leads to a power cord 49.

Referring now to FIGS. 5, 6, 7, 7A and 8–10, yet another embodiment of jack actuator according to the invention is indicated by the numeral 120 being manually user applied to a scissors jack 12*b* shown as having a steadying foot plate 29*b*. The actuator 120 includes a motor 125 disposed in a cylindrical motor housing 126 attached to a transmission housing 128 which latter rotatably mounts a user-applied coupling part in the form of an hexagonal socket 163 adapted to readily receive the hexagonal end 121 of the jack screw 18*b* during the applying of the actuator to the jack. The hexagonal cooperable surfaces of the socket 163 and screw end 121 constitute the coupling or mating parts. The motor housing 126 has a connector fitting 124 from which the power cord 50*b* leads, for connection to an appropriate power source such as the cigarette lighter socket in the motor vehicle.

Figure 8:
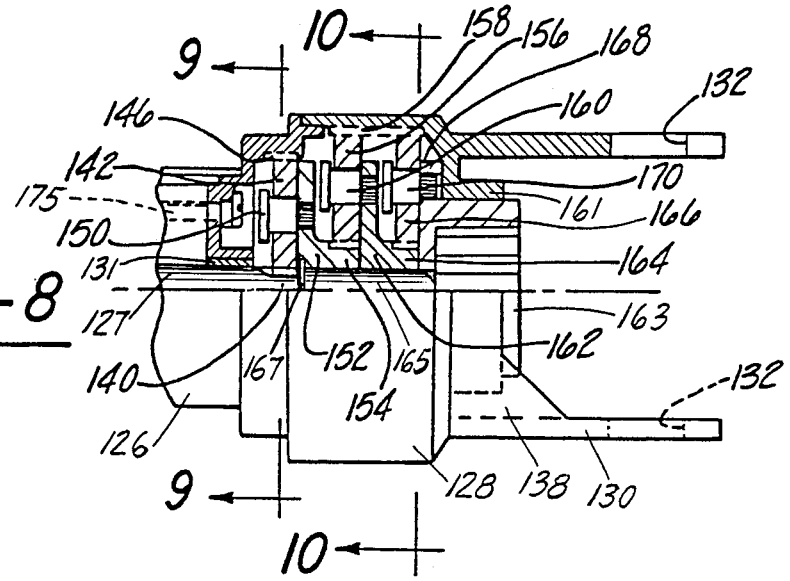
FIG. 8 is a partial sectional view of the planetary gear transmission of the jack actuator of FIGS. 5 and 6.

The transmission housing 128 rotatably mounts in a bearing 161 the tubular driver socket 163 which faces outwardly from, or is exposed exteriorly of, the housing 128 so as to be able to readily receive the hexagonal end 121 of the jack screw **18*b* therein. The socket part 163 of the attachment and the end part 121 of the jack screw constitute separable coupling parts wherein the socket part 163 can be easily user-applied to and user-detached from the screw end part 121, as can be readily understood by workers in the art. The housing 128 and jack 12*b* have cooperable interlocking means to prevent relative turning. As seen in FIG. 8, the housing 128 has an interlock device in the form of a forked attachment structure 138 comprising a pair of apertured members or arms 130 which extend axially away from the end of the casing 128 in spaced relation to the tubular socket 163. As best shown in FIGS. 8, 11 and 13, the arms 130 include registering hey-hole end slots 132 adapted to receive the enlarged-diameter stem portions of the interlock device comprising pivot screws or studs 134 threaded into a journal block 136 of the jack during the applying of the actuator to the jack by the user (see FIGS. 7 and 7A). The journal block 136 also constitutes a thrust bearing for cooperation with a collar portion 137 of the hexagonal head 121 on the screw 18*b***.

The forked attachment structure 138 automatically assumes the torque experienced by the motor housing 126 and transmission housing 128, and is quick acting and interlocking; it is preferably integrally constructed with the housing 128 as shown in FIG. 8 although it could be constituted as a separate piece. It will now be seen that when the driver socket 163 is slid over the hexagonal end 121 of the screw **18*b* by the user and the pivot screws 134 have been received in the slots 132, the actuator 120 is stably maintained in position for operating the jack and the latter assumes all the reactive torque as the motor 125** is energized.

The key-hole configuration of the slots 132 provides shoulders 133 thereon, which have the effect of locking the actuator 120 to the jack **12*b* against inadvertent separation during its use and especially at those times that the motor 125 is being energized either for raising or lowering movement. In addition, a spring wire clip 176 is provided by the invention (FIGS. 11 and 15), carried by the forked attachment structure 138 for engagement with the heads of the pivot screws 134 to interlock therewith. The clip 176 is U-shaped, having a yoke portion 178 and arms 179, 180 which latter terminate in eyes 182 that are adapted to snap in plave over the hexagonal heads of the screws 134 as seen in the figures. The yoke 178 portion can be attached in any suitable manner to the attachment structure 138**, as will be understood.

In conjunction with the forked attachment structure 138 which mounts the actuator 120 on the jack **12*b*, a handle 102 (FIGS. 5 and 14) threaded onto a ball-joint fitting 104 carried by the end cap 101 of the motor housing 126 can be provided to apply the actuator to the jack and to maintain it in stable operative position during its driving movement. The actuator is applied to the jack by the user, as will be understood. The ball joint fitting 104 can comprise a stub shaft 105 having a ball 106 received in a socket 107 integral with an hexagonal head 108 and screw 109. The handle 102 can be threaded onto the screw 109 to place it into use, or unscrewed therefrom if not desired. The handle 102 is also useful in aiding the manipulation of the jack into constricted spaced under the vehicle by the user, for example, and can assume various different positions with respect to the housing 126**, to suit the space available while still steadying the actuator.

Figure 9:
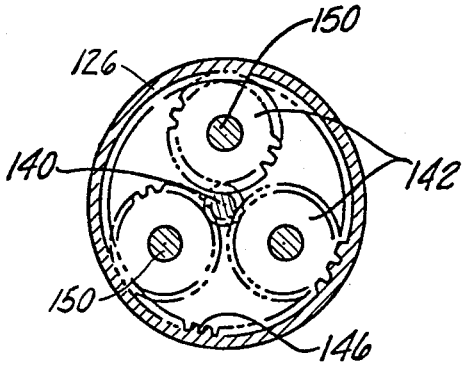
FIG. 9 is a sectional view taken substantially along the line 9—9 of FIG. 8.
Figure 10:
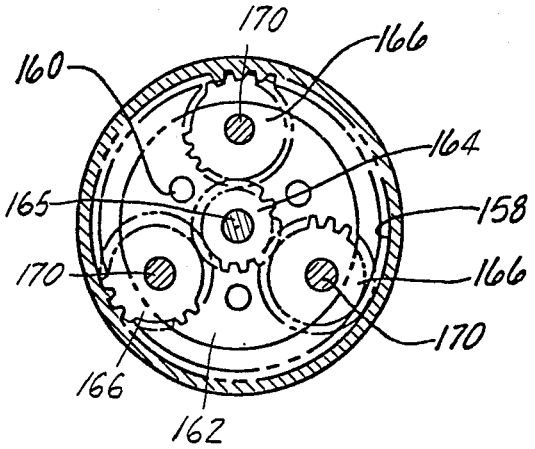
FIG. 10 is a sectional view taken substantially along the line 10—10 of FIG. 8.

Referring now to FIGS. 8–10, the in-line transmission portion of the unique jack actuator combination of the invention is illustrated in detail. Such transmission portion comprises a simplified, multi-stage in-line planetary gear reduction providing an extremely high ratio of approximately 180:1 and high efficiency to enable a relatively small, low-powered motor to exert the necessary forces to lift heavy vehicles, all without resorting to large electrical currents or power equipment. The transmission receives the high-speed low power motor output shaft 127 journaled in a bearing 131 of the motor 125 to provide a mechanical advantage at the tubular drive socket 163 of the actuator, as will now be described. As seen in FIG. 8, the motor housing 126 is assembled using tie bolts 175.

The transmission comprises a plurality of sets of sun and planet gears, the latter travelling in orbital paths within the motor housing 126 and transmission housing 128 which contain cooperable ring gearing. Many of the components of the transmission are duplicates of each other, resulting in a saving in tooling costs and inventory.

As seen in FIGS. 8 and 9, a sun gear 140 directly carried by the motor shaft 127 is engaged with a plurality of planet gears 142. The planet gears 142 are in turn engaged with an internal ring gear 146 formed on the inner periphery of the motor housing 126. A plurality of stub shafts 150 turnably mount the planet gears 142 and are secured to a disk-shaped carrier 152 having a sun gear 154. The sun gear 154 engages a plurality of planet gears 156 which also engage a ring gear 158 on the inner periphery of the transmission housing 128. Stub shafts 160 carry the planet gears 156 and are in turn secured to a carrier 162 having a sun gear 164 engaging a plurality of planet gears 166 which also engage the ring gear 158. Stub shafts 170 carry the planet gears 166 and are mounted on a carrier 168 which is integrally formed with the socket 163 having a bearing in a journal 161 of the housing 128.

Since the structural relationship between the gears 154, 156 and 158 is substantially the same as the structural arrangements between the gears 164, 166 and 158, only the relationship of the latter gears is shown in FIG. 10 for the sake of clarity and brevity.

The carriers 152, 162 and the socket 163 have in common a stub spindle 165 which is axially aligned with the motor shaft 127 and separated therefrom by an anti-friction disk 167 which can have any form. The stub spindle constitutes an axial bearing for the planetary gear carriers and can be free-turning, or alternatively it can be affixed to the last carrier 168, which has a powerful movement at slow speed. By having the stub spindle separate from the motor shaft 127 there is removed any additional frictional drag on the latter, which runs at high speed and has limited turning force as determined by the motor power. The disk 167 can be of anti-friction bearing material, or it can have a plurality of radial rollers (not shown) carried by a cage. The disk 167 also takes thrust to maintain the carrier elements of the transmission in axial position.

The three planet gears 156 and the three planet gears 166 are all duplicates of each other. Also, the stub shafts 150, 160 and 170 can be duplicates, numbering six in all. The carrier 152 can in most respects be a duplicate of the carrier 162. Such duplication results in savings in costs, as is well understood.

It will now be seen that as the motor shaft 127 and sun gear 140 turn, the planet gears 142 are forced to travel around the inside of the ring gear 146, whereby the carrier 152 rotates with the stub shafts 150 thereof moving in a circle about the centerline of the transmission and housing 126. Such rotation causes like rotation of the sun gear 154 which in turn causes the planet gears 156 to rotate and travel inside the ring gear 158. Similarly, the carrier 162 is rotated about the centerline of the transmission and housing 126, and causes a like rotation of the sun gear 164. Rotation of the sun gear 164 causes rotation of the planet gears 166 inside the ring gear 158. This in turn causes rotation of the carrier 168 so that the tubular socket 163 is rotated at reduced speed compared to the motor shaft 127 and with sufficient torque to operate the jack and lift the vehicle 27 above the ground.

The reduction ratio of the transmission illustrated in FIGS. 8–10 is advantageously on the order of 180:1, meaning that the motor shaft 127 will make 180 revolutions for each revolution of the drive socket 163.

Thus the present invention provides a lightweight, portable jack actuator constituted as a unit distinct and separate by itself, adapted for manual application by the user to a jack having a turnable operator such as a screw, and provides as well a simple, compact combination tool which is easily stored, transported user-applied and operated. Moreover, while the rotary drive means of the actuator can provide a mechanical advantage to the drive member or socket, the actuator housing is easily restrained against rotation by either manual grasping of the elongated handles which extend a substantial distance from the axis of rotation of the socket, or else by a mechanical connection to the jack by means of the forked attachment fitting 138. Furthermore, when both of the ends of the drive member or tubular socket are exposed as seen in FIGS. 1–3, either can be positioned to readily receive the hexagonal end of the operating screw of the jack, so as to permit raising or lowering of the load support as desired. Moreover, the actuator is conveniently powered by the existing electrical power system of the automobile to be lifted without modification of the electrical system.

From the above description of the present invention it will be evident that many modifications thereto will become apparent to those skilled in the art to which it pertains without departing from the scope and spirit of the appended claims.

What is claimed is:

1. Powered means for raising heavy objects, comprising in combination:

(a) a jack having a turnable operating screw, and (b) a separate, unitary, initially hand and user applied motorized actuator for said jack, said actuator being constituted as a unit complete in and of itself, separate and apart from said jack, and said actuator comprising, in combination:

(I) a housing, (II) an electric motor in said housing, having a drive shaft, (III) a drive member rotatably mounted on the housing and having means detachably cooperable with the jack screw to impart a turning movement to the latter, and (IV) positive drive means positively coupling said motor drive shaft to the drive member to turn the latter without slippage at a low fraction of the speed of the motor shaft, (V) said means which is detachably cooperable with the jack screw comprising a user-separable coupling part which can be user applied to, and which is cooperable with the jack screw and is readily user-separable therefrom, (VI) means for enabling repeated connection and disconnection of said jack and said housing by the user including interlocking means operable between said jack and said housing to prevent relative turning between said jack and said housing when the drive member is cooperating with the jack screw.

2. Powered means as set forth in claim 1, wherein:

(a) said drive means comprises an in-line multi-staged coaxial planetary step-down transmission in said housing, said transmission being axially aligned with the motor drive shaft and said drive member, (b) said transmission comprising ring-gear formations having a common axis which coincides with the axis of the motor drive shaft and of each stage of the said step-down transmission.

3. Powered means as set forth in claim 2, wherein:

(a) said interlocking means tends to lock the housing to the jack in response to relative turning forces acting between the same.

4. Powered means as set forth in claim 1, wherein:

(a) said interlocking means comprises a pair of aligned studs on the jack, and a fork carried by the housing, having slots for receiving the said studs.

5. Powered means as set forth in claim 3, wherein:

(a) said interlocking means comprises a stud on the jack, and an apertured member on the housing, said apertured member having a key-hole shaped slot for receiving said stud.

6. Powered means as set forth in claim 1, wherein:

(a) said housing has a handle, and (b) a universal joint mounting the handle on the housing to enable a user to effect various placements of the jack by manipulation of the handle.

7. Powered means as set forth in claim 6, wherein:

(a) said housing has means enabling the handle to be separated from the housing, for storage.

8. As a new article of manufacture, a unitary, initially hand and user applied motorized screw jack actuator constituted as a unit separate and apart from the screw jack, comprising in combination:

(a) a housing, (b) an electric motor in said housing, having a drive shaft, (c) a drive member rotatably mounted on the housing in alignment with the motor drive shaft and having means detachably cooperable with a jack screw to impart a turning movement to the latter, and (d) positive in-line drive means comprising a multi-staged coaxial planetary step-down transmission in said housing, axially aligned with the motor drive shaft and said drive member, and positively coupling said motor drive shaft to the drive member to turn the latter without slippage at a low fraction of the speed of the motor shaft, (e) said multi-staged planetary transmission comprising ring gear formations rigid with the housing, said ring gear formations having a common axis which coincides with the axis of the motor shaft and of each stage of the said step-down transmission, (f) said means which is detachably cooperable with the jack screw comprising a user-separable coupling part which can be user-applied to, and which is cooperable with the jack screw and is readly user-separable therefrom, (g) means for enabling repeated connection and disconnection of said jack and said housing by the user including interlocking means operable between said jack and said housing to prevent relative turning between said jack and said housing when the drive member is cooperating with the jack screw.

9. A motorized screw jack actuator as set forth in claim 8, wherein:

(a) said transmission has a stub spindle aligned with but separate from the drive shaft of the motor, (b) said stub spindle being common to the stages of the planetary transmission and constituting an axial bearing therefor.

10. A motorized screw jack actuator as set forth in claim 9, wherein:

(a) said transmission has an anti-friction bearing means between said stub spindle and drive shaft of the motor.

11. A motorized screw jack actuator as set forth in claim 8, wherein:

(a) said planetary transmission has three stages.

12. A powered lifting device comprising, in combination:

(a) a screw jack having an operating screw provided with a driven coupling part, (b) a unitary, initially hand and user applied motorized actuator constituted as a unit separate and apart from said screw jack, (c) said actuator comprising a housing, (d) an electric motor in said housing, having a drive shaft, (e) a drive member rotatably mounted on the housing in alignment with the motor drive shaft and having means detachably cooperable with the driven coupling part of the operating screw of the jack to impart a turning movement to the screw, (f) positive in-line drive means comprising a multi-staged coaxial planetary step-down transmission in said housing, axially aligned with the motor drive shaft and said drive member, and positively coupling said motor drive shaft to the drive member to turn the latter without slippage at a low fraction of the speed of the motor shaft, (g) said multi-staged planetary transmission comprising ring gear formations rigid with the housing, said ring gear formations having a common axis which coincides with the axis of the motor shaft and of each stage of the said step-down transmission, (h) said means which is detachably cooperable with the driven coupling part of the operating screw of the jack comprising a user-separable driving coupling part which can be user-applied to, and which is cooperable with said driven coupling part of the jack screw and is readily user-separable therefrom, (i) means for enabling repeated connection and disconnection of said jack and said housing by the user including interlocking means operable between said jack and said housing to prevent relative turning between said jack and said housing when the drive member is cooperating with the jack screw, and (j) a foot plate on said screw jack to enable the same to be steadied by a user through the medium of applying his or her foot thereto.

13. A motorized screw jack actuator as set forth in claim 12, wherein:

(a) said interlock device tends to lock the housing to the jack in response to relative turning forces acting between the same.

14. A motorized screw jack actuator as set forth in claim 12, wherein:

(a) said interlock device comprises a fork carried by the housing, having slots adapted to receive portions of said jack.

15. A motorized screw jack actuator as set forth in claim 13, wherein:

(a) said interlock device comprises an apertured member on the housing, (b) said apertured member having a key-hole shaped slot adapted to receive portions of said jack.

16. A motorized screw jack actuator as set forth in claim 12, wherein:

(a) said housing has a spring clip cooperable with portions of the screw jack for retaining the housing in place thereon after the drive member has been engaged to drive the screw of the jack.

* * * * *